US008203281B2

(12) United States Patent
Cegnar et al.

(10) Patent No.: US 8,203,281 B2
(45) Date of Patent: Jun. 19, 2012

(54) WIDE VOLTAGE, HIGH EFFICIENCY LED DRIVER CIRCUIT

(75) Inventors: Erik J. Cegnar, Moscow, ID (US); Fred Jessup, Moscow, ID (US); Mike Maughan, Moscow, ID (US); David G. Alexander, Moscow, ID (US)

(73) Assignee: IVUS Industries, LLC, Moscow, ID (US)

( * ) Notice: Subject to any disclaimer, the term of this patent is extended or adjusted under 35 U.S.C. 154(b) by 536 days.

(21) Appl. No.: 12/432,331

(22) Filed: Apr. 29, 2009

(65) Prior Publication Data

US 2009/0315484 A1 Dec. 24, 2009

Related U.S. Application Data

(60) Provisional application No. 61/048,711, filed on Apr. 29, 2008.

(51) Int. Cl.
*H05B 37/02* (2006.01)

(52) U.S. Cl. ..... 315/291; 315/244; 315/307

(58) Field of Classification Search ..... 315/209 R, 315/244–246, 291, 307, 185 R, 224, 225
See application file for complete search history.

(56) References Cited

U.S. PATENT DOCUMENTS

| | | | | |
|---|---|---|---|---|
| 5,714,864 | A | 2/1998 | Rose | |
| 5,877,596 | A | 3/1999 | Allison | |
| 6,011,379 | A | 1/2000 | Singh | |
| 6,051,935 | A * | 4/2000 | Bucks et al. | 315/224 |
| 6,066,936 | A | 5/2000 | Okamura | |
| 6,104,169 | A | 8/2000 | Radys | |
| 6,150,774 | A | 11/2000 | Mueller | |
| 6,166,496 | A | 12/2000 | Lys | |
| 6,265,851 | B1 | 7/2001 | Brien | |
| 6,281,660 | B1 | 8/2001 | Abe | |
| 6,292,901 | B1 | 9/2001 | Lys | |
| 6,340,868 | B1 | 1/2002 | Lys | |
| 6,359,392 | B1 | 3/2002 | He | |
| 6,400,101 | B1 * | 6/2002 | Biebl et al. | 315/291 |
| 6,528,954 | B1 | 3/2003 | Lys | |
| 6,548,967 | B1 | 4/2003 | Dowling | |
| 6,577,080 | B2 | 6/2003 | Lys | |
| 6,586,890 | B2 | 7/2003 | Min et al. | |
| 6,591,758 | B2 | 7/2003 | Kumar | |
| 6,608,453 | B2 | 8/2003 | Morgan | |
| 6,612,246 | B2 | 9/2003 | Kumar | |
| 6,624,597 | B2 | 9/2003 | Dowling | |
| 6,639,381 | B2 | 10/2003 | Tamura | |

(Continued)

FOREIGN PATENT DOCUMENTS

AU 2004200183 12/2004

(Continued)

OTHER PUBLICATIONS

The International Preliminary Report on Patentability dated Nov. 11, 2010, with Written Opinion, (Chapter I of the PCT) for PCT/US2009/042110.

(Continued)

*Primary Examiner* — Jacob Y Choi
*Assistant Examiner* — Jimmy Vu
(74) *Attorney, Agent, or Firm* — Buchanan Nipper

(57) ABSTRACT

An electrical circuit and method for driving light emitting diodes with a constant current via a high efficiency DC-DC converter controlled by a digital controller through pulse width modulation (PWM).

22 Claims, 2 Drawing Sheets

U.S. PATENT DOCUMENTS

| | | | | |
|---|---|---|---|---|
| 6,664,766 | B2 | 12/2003 | Desprez | |
| 6,690,146 | B2 | 2/2004 | Burgyan et al. | |
| 6,717,376 | B2 | 4/2004 | Lys | |
| 6,720,745 | B2 | 4/2004 | Lys | |
| 6,774,584 | B2 | 8/2004 | Lys | |
| 6,777,891 | B2 | 8/2004 | Lys | |
| 6,781,329 | B2 | 8/2004 | Mueller | |
| 6,788,011 | B2 | 9/2004 | Mueller | |
| 6,801,003 | B2 | 10/2004 | Schanberger | |
| 6,806,659 | B1 | 10/2004 | Mueller | |
| 6,836,081 | B2 | 12/2004 | Swanson et al. | |
| 6,836,098 | B1 | 12/2004 | O'Brien | |
| 6,847,192 | B2 | 1/2005 | Turner | |
| 6,869,204 | B2 | 3/2005 | Morgan | |
| 6,888,322 | B2 | 5/2005 | Dowling | |
| 6,897,624 | B2 | 5/2005 | Lys | |
| 6,936,978 | B2 | 8/2005 | Morgan | |
| 6,965,205 | B2 | 11/2005 | Piepgras | |
| 6,967,448 | B2 | 11/2005 | Morgan | |
| 6,969,954 | B2 | 11/2005 | Lys | |
| 6,975,079 | B2 | 12/2005 | Lys | |
| 7,014,336 | B1 | 3/2006 | Ducharme | |
| 7,015,674 | B2 | 3/2006 | VonderHaar | |
| 7,019,492 | B1 | 3/2006 | Baker | |
| 7,031,920 | B2 | 4/2006 | Dowling | |
| 7,038,398 | B1 | 5/2006 | Lys | |
| 7,038,399 | B2 | 5/2006 | Lys | |
| 7,042,172 | B2 | 5/2006 | Dowling | |
| 7,042,197 | B2 | 5/2006 | Turner | |
| 7,064,498 | B2 | 6/2006 | Dowling | |
| 7,113,541 | B1 | 9/2006 | Lys | |
| 1,776,086 | A1 | 10/2006 | Burgyan et al. | |
| 7,132,785 | B2 | 11/2006 | Ducharme | |
| 7,132,804 | B2 | 11/2006 | Lys | |
| 7,135,824 | B2 | 11/2006 | Lys | |
| 7,139,617 | B1 | 11/2006 | Morgan | |
| 7,161,311 | B2 | 1/2007 | Mueller | |
| 7,161,313 | B2 | 1/2007 | Piepgras | |
| 7,161,556 | B2 | 1/2007 | Morgan | |
| 7,180,252 | B2 | 2/2007 | Lys | |
| 7,186,003 | B2 | 3/2007 | Dowling | |
| 7,187,141 | B2 | 3/2007 | Mueller | |
| 7,202,613 | B2 | 4/2007 | Morgan | |
| 7,204,622 | B2 | 4/2007 | Dowling | |
| 7,218,489 | B2 | 5/2007 | Wilk et al. | |
| 7,221,104 | B2 | 5/2007 | Lys | |
| 7,228,190 | B2 | 6/2007 | Dowling | |
| 7,231,060 | B2 | 6/2007 | Dowling | |
| 7,233,115 | B2 | 6/2007 | Lys | |
| 7,233,831 | B2 | 6/2007 | Blackwell | |
| 7,242,152 | B2 | 7/2007 | Dowling | |
| 7,248,239 | B2 | 7/2007 | Dowling | |
| 7,255,457 | B2 | 8/2007 | Ducharme | |
| 7,256,554 | B2 | 8/2007 | Lys | |
| 7,265,504 | B2 | 9/2007 | Grant | |
| 7,274,160 | B2 | 9/2007 | Mueller | |
| 7,300,192 | B2 | 11/2007 | Mueller | |
| 7,303,300 | B2 | 12/2007 | Dowling | |
| 7,308,296 | B2 | 12/2007 | Lys | |
| 7,309,965 | B2 | 12/2007 | Dowling | |
| 7,344,279 | B2 | 3/2008 | Mueller | |
| 7,350,936 | B2 | 4/2008 | Ducharme | |
| 7,352,138 | B2 | 4/2008 | Lys | |
| 7,352,339 | B2 | 4/2008 | Morgan | |
| 7,353,071 | B2 | 4/2008 | Blackwell | |
| 7,354,172 | B2 | 4/2008 | Chemel | |
| 7,358,706 | B2 | 4/2008 | Lys | |
| 7,358,929 | B2 | 4/2008 | Mueller | |
| 7,387,405 | B2 | 6/2008 | Ducharme | |
| 7,425,803 | B2 * | 9/2008 | Shao et al. | 315/308 |
| 7,427,840 | B2 | 9/2008 | Morgan | |
| 7,449,847 | B2 | 11/2008 | Schanberger | |
| 7,453,217 | B2 | 11/2008 | Lys | |
| 7,462,997 | B2 | 12/2008 | Mueller | |
| 7,482,764 | B2 | 1/2009 | Morgan | |
| 7,495,671 | B2 | 2/2009 | Chemel | |
| 7,502,034 | B2 | 3/2009 | Chemel | |
| 7,515,128 | B2 | 4/2009 | Dowling | |
| 7,525,254 | B2 | 4/2009 | Lys | |
| 2001/0028227 | A1 | 10/2001 | Lys | |
| 2002/0011538 | A1 | 1/2002 | Flamm | |
| 2002/0038157 | A1 | 3/2002 | Dowling | |
| 2002/0044066 | A1 | 4/2002 | Dowling | |
| 2002/0047569 | A1 | 4/2002 | Dowling | |
| 2002/0047628 | A1 | 4/2002 | Morgan | |
| 2002/0047646 | A1 | 4/2002 | Lys | |
| 2002/0048169 | A1 | 4/2002 | Dowling | |
| 2002/0057061 | A1 | 5/2002 | Mueller | |
| 2002/0057886 | A1 | 5/2002 | Ando | |
| 2002/0070688 | A1 | 6/2002 | Dowling | |
| 2002/0074559 | A1 | 6/2002 | Dowling | |
| 2002/0078221 | A1 | 6/2002 | Blackwell | |
| 2002/0101197 | A1 | 8/2002 | Lys | |
| 2002/0101200 | A1 | 8/2002 | Dowling | |
| 2002/0105373 | A1 | 8/2002 | Sudo | |
| 2002/0113555 | A1 | 8/2002 | Lys | |
| 2002/0130627 | A1 | 9/2002 | Morgan | |
| 2002/0145394 | A1 | 10/2002 | Morgan | |
| 2002/0152045 | A1 | 10/2002 | Dowling | |
| 2002/0153851 | A1 | 10/2002 | Morgan | |
| 2002/0158583 | A1 | 10/2002 | Lys | |
| 2002/0163316 | A1 | 11/2002 | Lys | |
| 2002/0171365 | A1 | 11/2002 | Morgan | |
| 2002/0171377 | A1 | 11/2002 | Mueller | |
| 2002/0171378 | A1 | 11/2002 | Morgan | |
| 2002/0174798 | A1 | 11/2002 | Kumar | |
| 2002/0176259 | A1 | 11/2002 | Ducharme | |
| 2002/0177929 | A1 | 11/2002 | Kumar | |
| 2002/0195975 | A1 | 12/2002 | Schanberger | |
| 2003/0011538 | A1 | 1/2003 | Lys | |
| 2003/0028260 | A1 | 2/2003 | Blackwell | |
| 2003/0057866 | A1 | 3/2003 | Takahashi | |
| 2003/0057884 | A1 | 3/2003 | Dowling | |
| 2003/0057887 | A1 | 3/2003 | Dowling | |
| 2003/0057890 | A1 | 3/2003 | Lys | |
| 2003/0062876 | A1 | 4/2003 | Desprez | |
| 2003/0076281 | A1 | 4/2003 | Morgan | |
| 2003/0076291 | A1 | 4/2003 | Ma | |
| 2003/0080712 | A1 | 5/2003 | Tamura | |
| 2003/0100837 | A1 | 5/2003 | Lys | |
| 2003/0133292 | A1 | 7/2003 | Mueller | |
| 2003/0137258 | A1 | 7/2003 | Piepgras | |
| 2003/0184258 | A1 | 10/2003 | VonderHaar | |
| 2003/0197487 | A1 | 10/2003 | Tamura | |
| 2003/0206411 | A9 | 11/2003 | Dowling | |
| 2003/0214259 | A9 | 11/2003 | Dowling | |
| 2003/0222587 | A1 | 12/2003 | Dowling, Jr. | |
| 2004/0032226 | A1 | 2/2004 | Lys | |
| 2004/0041620 | A1 | 3/2004 | D'Angelo et al. | |
| 2004/0090191 | A1 | 5/2004 | Mueller | |
| 2004/0090787 | A1 | 5/2004 | Dowling | |
| 2004/0105261 | A1 | 6/2004 | Ducharme | |
| 2004/0113568 | A1 | 6/2004 | Dowling | |
| 2004/0130909 | A1 | 7/2004 | Mueller | |
| 2004/0155609 | A1 | 8/2004 | Lys | |
| 2004/0160199 | A1 | 8/2004 | Morgan | |
| 2004/0178751 | A1 | 9/2004 | Mueller | |
| 2004/0212320 | A1 | 10/2004 | Dowling | |
| 2004/0212321 | A1 | 10/2004 | Lys | |
| 2004/0212993 | A1 | 10/2004 | Morgan | |
| 2004/0250890 | A1 | 12/2004 | Nishikawa | |
| 2004/0251880 | A1 * | 12/2004 | O'Brien | 320/166 |
| 2004/0257007 | A1 | 12/2004 | Lys | |
| 2004/0263127 | A1 | 12/2004 | Turner | |
| 2005/0030744 | A1 | 2/2005 | Ducharme | |
| 2005/0035728 | A1 | 2/2005 | Schanberger | |
| 2005/0036300 | A1 | 2/2005 | Dowling | |
| 2005/0040774 | A1 | 2/2005 | Mueller | |
| 2005/0041161 | A1 | 2/2005 | Dowling | |
| 2005/0041424 | A1 | 2/2005 | Ducharme | |
| 2005/0047132 | A1 | 3/2005 | Dowling | |
| 2005/0047134 | A1 | 3/2005 | Mueller | |
| 2005/0063194 | A1 | 3/2005 | Lys | |
| 2005/0099824 | A1 | 5/2005 | Dowling | |
| 2005/0151489 | A1 | 7/2005 | Lys | |
| 2005/0174473 | A1 | 8/2005 | Morgan | |
| 2005/0213353 | A1 | 9/2005 | Lys | |

| | | | | |
|---|---|---|---|---|
| 2005/0218838 | A1* | 10/2005 | Lys | 315/291 |
| 2005/0218870 | A1 | 10/2005 | Lys | |
| 2005/0231133 | A1 | 10/2005 | Lys | |
| 2005/0236998 | A1 | 10/2005 | Mueller | |
| 2005/0253533 | A1 | 11/2005 | Lys | |
| 2005/0275626 | A1 | 12/2005 | Mueller | |
| 2005/0285547 | A1 | 12/2005 | Piepgras | |
| 2006/0002110 | A1 | 1/2006 | Dowling | |
| 2006/0016960 | A1 | 1/2006 | Morgan | |
| 2006/0022214 | A1 | 2/2006 | Morgan | |
| 2006/0076908 | A1 | 4/2006 | Morgan | |
| 2006/0098077 | A1 | 5/2006 | Dowling | |
| 2006/0109649 | A1 | 5/2006 | Ducharme | |
| 2006/0152172 | A9 | 7/2006 | Mueller | |
| 2006/0208667 | A1 | 9/2006 | Lys | |
| 2006/0221606 | A1 | 10/2006 | Dowling | |
| 2006/0285325 | A1 | 12/2006 | Ducharme | |
| 2007/0047227 | A1 | 3/2007 | Ducharme | |
| 2007/0086754 | A1 | 4/2007 | Lys | |
| 2007/0086912 | A1 | 4/2007 | Dowling | |
| 2007/0115658 | A1 | 5/2007 | Mueller | |
| 2007/0153514 | A1 | 7/2007 | Dowling | |
| 2007/0188427 | A1 | 8/2007 | Lys | |
| 2007/0195526 | A1 | 8/2007 | Dowling | |
| 2007/0206375 | A1 | 9/2007 | Piepgras | |
| 2007/0237284 | A1 | 10/2007 | Lys | |
| 2007/0258240 | A1 | 11/2007 | Ducharme | |
| 2008/0012502 | A1 | 1/2008 | Lys | |
| 2008/0012506 | A1 | 1/2008 | Mueller | |
| 2008/0130267 | A1 | 6/2008 | Dowling | |
| 2008/0140231 | A1 | 6/2008 | Blackwell | |
| 2008/0183081 | A1 | 7/2008 | Lys | |
| 2008/0215391 | A1 | 9/2008 | Dowling | |
| 2008/0224625 | A1* | 9/2008 | Greenfeld | 315/201 |

FOREIGN PATENT DOCUMENTS

| | | |
|---|---|---|
| AU | 2006202217 | 6/2006 |
| AU | 2007216901 | 10/2007 |
| CA | 2302227 | 3/1999 |
| CA | 2466717 | 3/1999 |
| CA | 2314163 | 6/1999 |
| CA | 2336184 | 1/2000 |
| CA | 2559718 | 9/2005 |
| CA | 2579196 | 3/2006 |
| CA | 2591133 | 6/2006 |
| CA | 2591205 | 7/2006 |
| CN | 1809867 | 7/2006 |
| EP | 1172748 | 1/2002 |
| EP | 1195740 | 4/2002 |
| EP | 1422975 | 5/2004 |
| EP | 1610593 | 12/2005 |
| EP | 1887836 | 2/2008 |
| JP | 2004006253 | 8/2004 |
| JP | 2006325396 | 11/2006 |
| JP | 2008034385 | 2/2008 |
| JP | 2008078162 | 3/2008 |
| JP | 20080099352 | 11/2008 |
| JP | 2009070832 | 4/2009 |
| KR | 20060108757 | 10/2006 |
| KR | 20060119018 | 11/2006 |
| KR | 20060131985 | 12/2006 |
| WO | 8905086 | 6/1989 |
| WO | 9910867 | 3/1999 |
| WO | WO9910867 | 3/1999 |
| WO | 9931560 | 6/1999 |
| WO | 0001067 | 1/2000 |
| WO | 0105195 | 1/2001 |
| WO | 0124584 | 4/2001 |
| WO | 0136864 | 5/2001 |
| WO | 0182657 | 11/2001 |
| WO | 0199475 | 12/2001 |
| WO | 0210847 | 2/2002 |
| WO | 0211497 | 2/2002 |
| WO | 0212127 | 2/2002 |
| WO | 0213490 | 2/2002 |
| WO | 0218913 | 3/2002 |
| WO | 0225842 | 3/2002 |
| WO | 0240921 | 5/2002 |
| WO | 02045467 | 6/2002 |
| WO | 02061330 | 8/2002 |
| WO | 02069306 | 9/2002 |
| WO | 02091805 | 11/2002 |
| WO | 02098182 | 12/2002 |
| WO | 02098183 | 12/2002 |
| WO | 02099780 | 12/2002 |
| WO | 02101702 | 12/2002 |
| WO | 03024269 | 3/2003 |
| WO | 03026358 | 3/2003 |
| WO | 03055273 | 7/2003 |
| WO | 03096761 | 11/2003 |
| WO | 2004021747 | 3/2004 |
| WO | 2004023850 | 3/2004 |
| WO | 2004032572 | 4/2004 |
| WO | 20040890291 | 9/2004 |
| WO | 2004094896 | 11/2004 |
| WO | 2005012997 | 2/2005 |
| WO | 2005052751 | 6/2005 |
| WO | 2005060309 | 6/2005 |
| WO | 2005084339 | 9/2005 |
| WO | 2005089309 | 9/2005 |
| WO | 2008089293 | 9/2005 |
| WO | 2006023149 | 3/2006 |
| WO | 2006031753 | 3/2006 |
| WO | 2006069002 | 6/2006 |
| WO | 2006069117 | 6/2006 |
| WO | 2006071628 | 7/2006 |
| WO | 2007064694 | 6/2007 |

OTHER PUBLICATIONS

Bhattacharya et al., 'Digital sliding mode pulsed current averaging IC drivers for high brightness light emitting diodes', 10th IEEE Workshop on computers in Power Electronics, Jul. 16-19, 2006, IEEE 2006, ISBN 0-7803-9724-X, pp. 136-141.

Lee et al., 'New design and application of high efficiency LED driving system for RGB-LED backlight in LCD display', 2006 IEEE Power Electronics Specialists Conference, Jun. 18-22, 2006, IEEE, 2006, ISBN 1-4244-9717-7.

Calleja et al., 'Evaluation of power LEDs drivers with supercapacitors and digital control', Proceedings of the 42nd IAS Annual Meeting, IEEE, Sep. 2007, pp. 1129-1134, DOI: 10.1109/07IAS.2007.17.

International Search Report for corresponding PCT application No. PCT/US2009/042110.

* cited by examiner

WIDE VOLTAGE, HIGH EFFICIENCY LED DRIVER CIRCUIT

PRIORITY/CROSS-REFERENCE TO RELATED APPLICATIONS

This application claims the priority date of the provisional application entitled "Power Regulation System" filed by Erik J. Cegner, Fred Jessup, Mike Maughan and David G. Alexander on Apr. 29, 2008 with application Ser. No. 61/048,711, the disclosure of which is incorporated herein by reference.

FIELD OF THE INVENTION

The invention generally relates to driver circuits for light emitting diodes (LEDs) which can be powered by batteries or ultracapacitors, and in particular relates to a LED driver circuit which is powered by ultracapacitors.

DEFINITIONS

As used herein, the following terms have the following meanings:

a. The term "LED" refers to a light emitting diode.
b. The term "ultracapacitor" refers to a capacitor exhibiting a very high energy density (>0.5 Wh/l), including double layer capacitors, supercapacitors, pseudocapacitors, and hybrid capacitors.
c. The term "microcontroller" refers to a device with electrical inputs and outputs that performs a digital process (e.g., digital signal controllers, microprocessors, digital controllers, digital signal processors).
d. The term "energy storage system" ("energy source") refers to anything that stores energy and provides power to the system, including but not limited to ultracapacitors and batteries.

BACKGROUND OF THE INVENTION

Most power output systems are designed to operate at relatively constant voltage because this is typical of the discharge characteristics of most battery chemistries. In comparison to battery chemistries, state of the art ultracapacitor devices store less energy per volume and weight. Also, ultracapacitor discharge curves are significantly different than battery discharge curves. Battery discharge curves are relatively flat as most of the energy is dissipated from the devices. Most systems are designed to operate in this relatively flat portion of the curve. Ultracapacitors, on the other hand, do not have a flat voltage region. Instead, the voltage varies approximately linearly with a constant current discharge.

Ultracapacitors are commonly viewed or modeled as an ideal capacitor. In fact, the device is considerably more complex. However, for the purposes of this discussion the ideal capacitor model will be used. Equation 1 describes the relationship between voltage, current, and capacitance of an ideal ultracapacitor.

$$i(t) = C\frac{dv}{dt} \qquad \text{(Equation 1)}$$

From this equation it is known that for a constant discharge current, the voltage of an ultracapacitor varies linearly with a slope of dv/dt being equal in magnitude to I(t)/C. Also, the amount of stored energy that can be used from an ultracapacitor is dependant on the amount of voltage swing a system can allow. For an ultracapacitor with a given capacitance C, and an allowable voltage swing from $V_{high}$ to $V_{low}$ the amount of usable energy can be calculated from Equation 2.

$$E_{uc} = \frac{1}{2}C(V_{high}^2 - V_{low}^2) \qquad \text{(Equation 2)}$$

From Equation 2, it is clear that the larger the allowable voltage swing of an ultracapacitor cell, the larger the amount of stored energy that can be utilized. Therefore, a system that best utilizes the energy storage capabilities of an ultracapacitor is a system that can allow for the largest voltage swing possible.

Primary and secondary battery powered systems can also benefit from systems that allow for a large voltage swing. However, because a smaller percentage of a battery's usable energy is utilized by a wide voltage swing, the gain is less significant with a battery than it is with an ultracapacitor.

Recently, white and color LED technology has improved significantly. The color quality, efficacy, and total light output per device continue to improve. Because of these recent advancements LEDs are being used more frequently in consumer and commercial applications.

LEDs exhibit a nonlinear voltage to current relationship and the voltage for a given current will vary slightly from device to device. The amount of light emitted from an LED at a given temperature is based on current. Therefore, in order to achieve a consistent and predictable light output it is best to drive the LED with a constant current.

Currently there exist many methods of driving LEDs. Many of these circuits drive LEDs with a constant current, but the current regulation is poor and therefore the light output varies as the input voltage to the circuit goes down. The input voltage of ultracapacitors and batteries go down during discharge. Furthermore, existing circuits have a limited input voltage range in comparison to the disclosed technology. And over this limited range the efficiency may be very low. For ultracapacitor systems, the efficiency is critical because the energy density is typically lower for state of the art ultracapacitors vs. state of the art batteries. However, efficiency is still important for battery-powered systems as well as other sources of electrical power.

Digital controllers can provide unique functionality to consumer products. In the case of hand-held lighting the use of a digital controller can provide, for example, unique light output profiles based on input voltage, unique types of user interface and unique flash patterns. State of charge and other calculations can easily be performed. Digital controllers can also operate down to very low voltages, which make them advantageous in control systems over alternative methods.

DESCRIPTION OF THE PREFERRED EMBODIMENTS

Figure 1:
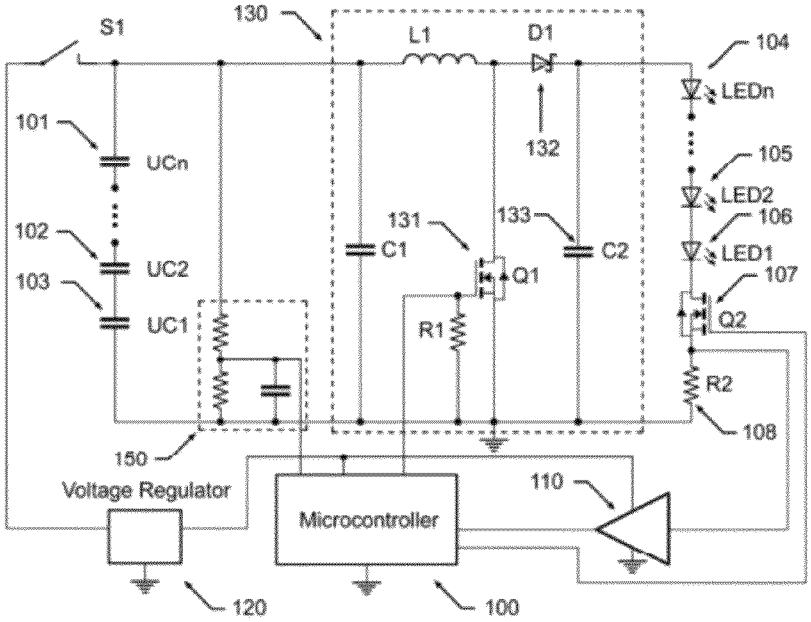
FIG. 1 is a high level schematic of a circuit for driving high power LEDs.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

Referring initially to FIG. 1, shown is a high level schematic of the circuit for driving high power LEDs. The circuit includes ultracapacitors (101-103) for energy storage from and series connected LEDs (104-106). The ultracapacitors could be connected in series, parallel or combinations of series and parallel.

Figure 2:
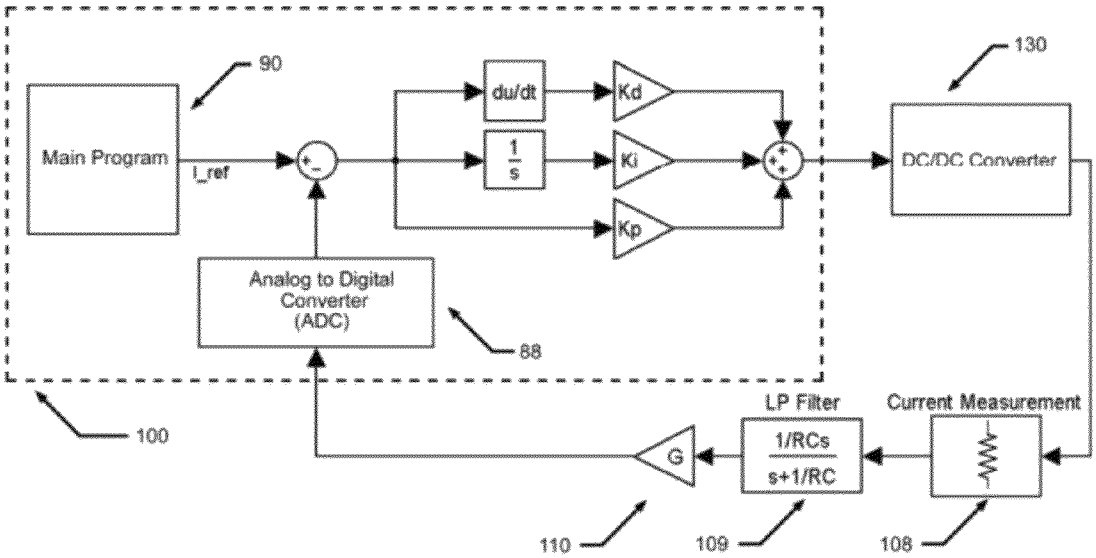
FIG. 2 is a block diagram of a control system representing the microcontroller, DC/DC Converter, and current feedback circuit.

FIG. 2 shows a block diagram of the control system representing the microcontroller (100), DC/DC Converter (130), and current feedback circuit. The feedback circuit represents a measurement resistor (108), a filter (109), and an operational amplifier circuit (110) to provide gain to the current feedback signal.

The LED driver circuit powers high-powered LEDs by controlling the current through them. The preferred system uses closed-loop proportional-integral-derivative (PID) control to ensure a well regulated constant current over a very wide range of input voltages. Alternatively, integral control, proportional control, or proportional-integral control could be used. In this embodiment the derivative gain is set to zero. The current from the output of the DC-DC boost converter (130) is controlled by a pulse width modulation (PWM) signal from the microcontroller (100).

The main microcontroller program (90) generates an internal reference current (I_ref) to the PID control loop. The reference current (I_ref) may be a constant or a function based on a discharge profile or various other inputs and parameters. The current from the DC/DC boost converter (130) is measured by a resistor (108) connected in series with the LEDs. The small value of the 0.2 Ω measurement resistor (108) results in a dissipation that is a very small percentage of less than 1% of the total output of power. The voltage over the measurement resistor (108) is filtered by the filter (109) and amplified by an operational amplifier circuit (110). The microcontroller (100) then converts the amplified signal to a digital number by use of an analog to digital converter (ADC) (88).

Closed loop control is performed within the microcontroller (100) and is based on the measured current and the program generated reference current. Within the PID loop, the digital value representing the measured current is subtracted from the program-generated reference current. The difference between the two is the error. Three terms are generated based on the error. A proportional term is generated by multiplying the error by the proportional gain (Kp). An integral term is generated by integrating with the error with respect to time and multiplying it by the integral gain (Ki). A derivative term is generated by taking the derivative of the error with respect to time and multiplying it by the derivative term (Kd). In this embodiment the derivative gain is set to zero.

The proportional gain, the integral gain and the derivative gain are summed to generate a digital value for the PWM signal. The microcontroller's built-in PWM generator uses the PWM value to generate a PWM signal for the DC-DC boost converter. The use of a PID control loop ensures that the generated PWM signal is such that the DC-DC boost converter outputs the commanded current to a very high degree of accuracy.

Figure 3:
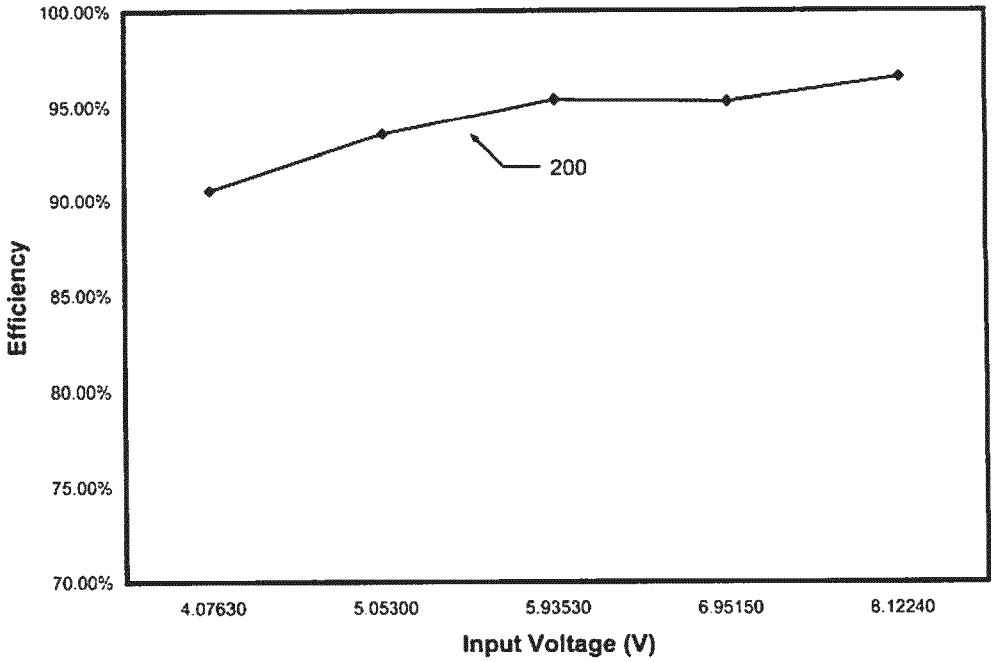
FIG. 3 is a graph of efficiency of one embodiment of the system/DC-DC boost converter.

FIG. 3 is a graph of efficiency of the system/DC-DC boost converter powering three white LEDs over the range of input voltages from roughly 4.0 to 8.15 volts. The efficiency is over 90% for this range.

Figure 4:
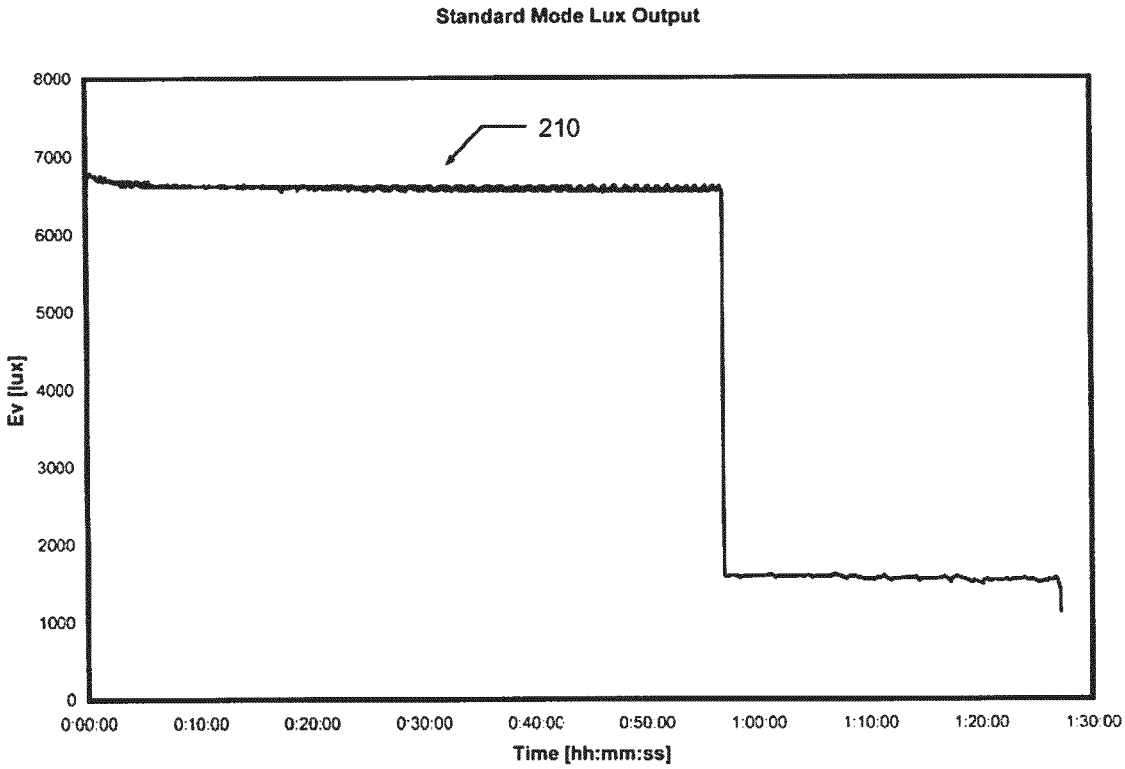
FIG. 4 is a graph of lux vs. time as produced by one embodiment of the disclosed invention as measured with a lux meter.

FIG. 4 is a graph of lux vs. time as produced by the disclosed invention and measured with a lux meter. The circuit is powered with ultracapacitors during data collection. The voltage of the ultracapacitors decreases from 8.1 to 1.8 volts during this operation. The graph has two distinct operating modes where a first mode has a high light output and a second mode has a low light output. FIG. 4 illustrates clearly a very well regulated flat light output curve with two distinct operating modes during the ultracapacitor discharge.

The DC-DC converter transfers energy to the output based on the PWM signal. The PWM signal is modulated by changing the period of time when the signal is high versus when the signal is low. When the signal is high the mosfet (131) turns on and conducts current. When it is low the mosfet is off and not conducting current. When the mosfet is on, current is increasing in the inductor and the diode (132) is reverse biased and not conducting. When the mosfet turns off the diode becomes forward biased and current flows from the source through the inductor and the diode and into the bulk capacitor (133) and the LEDs (104-106). During this time, the current through the inductor is decreasing. This configuration contributes to a high efficiency because the voltage drop over the diode (132) is proportionally less than the total output voltage when the diode is forward biased. In this embodiment, the output voltage is approximately 10V and the voltage drop over the diode while it is conducting is approximately 0.3V.

A turn-off transistor (107) prevents current from flowing from the energy system to the LEDs when the system in not operating. Said turn-off transistor is controlled by the microcontroller (100) by means of a digital signal. Said turn-off transistor also provides the circuit with the capability of turning the LEDs on and off rapidly. This function is important for strobe type flashing modes of operation.

Beyond the closed-loop control the microcontroller performs other various functions. As discussed above, the microcontroller generates an internal reference current. The dc-dc converter follows this current. The internal reference current is a function of the mode of operation and the voltage of the energy storage system. The mode of operation may or may not be user selectable. The reference current may also be based other inputs such as user input buttons, temperature and time.

Ultracapacitors provide unique advantages to systems such as long life and quick recharge. In order to take advantage of these characteristics a unique system is needed. The system must have a wide input voltage range, a very high efficiency and a very well regulated output.

The disclosed invention provides these necessary characteristics to make ultracapacitors a viable source to power LEDs in hand-held products and other applications.

In the disclosed invention, a high efficiency dc-dc converter (130) is controlled by a digital controller (100) through pulse width modulation (PWM). A low-dropout linear regulator (120) prevents the input voltage to the digital controller from exceeding its maximum voltage. A very low power consumption measurement circuit provides current feedback to said digital controller. Said digital controller performs closed-loop current control.

One example embodiment: An electrical circuit for driving high output LEDs with a constant current is disclosed. The circuit is configured in a manner that lends itself to a very wide input voltage range with high efficiency over that wide operating range. The circuit can achieve a peak efficiency of greater than 96% with an operating range from 10 volts down to 1.5 volts. This embodiment provides an operating range of up to 10 volts; however it is not limited to 10 volts. Because of this wide voltage range and high efficiency the circuit is particularly beneficial to ultracapacitor-powered systems. However, it also provides benefit to battery powered systems because it operates at a very high efficiency and allows the battery voltage to decrease significantly below its nominal voltage while still providing a regulated output. Closed loop current control is provided by a microcontroller. The current through the LEDs is measured by amplifying the voltage over a measurement resistor. The use of a microcontroller to provide closed loop control provides the system with the ability to operate to a very low voltage (1.5 volts) and provides unique custom control and functionality. The system provides a very constant light output as the batteries or ultracapacitors discharge. FIG. 4 shows two distinct operating modes where a first mode has a high light output and a second mode has a low light output as measured with a lux meter. At approximately one hour, the driver distinctly switches to a lower output mode. These two "flat" output modes are uncommon in most existing LED drivers and light output systems.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A LED driver circuit for powering a plurality of light emitting diodes with a power source, said circuit comprising:

a DC-DC converter powered by said power source, said DC-DC converter for providing current to said light emitting diodes, said DC-DC converter controlled by a microcontroller through pulse width modulation (PWM);

a current feedback circuit for measuring the output of said DC-DC converter, said current feedback circuit comprising a measurement resistor connected in series with said light emitting diodes, wherein voltage measured across said measurement resistor is filtered by a filter and amplified by an operational amplifier to create an analog amplified signal; and said microcontroller, said microcontroller for generating a digital reference current, said microcontroller comprising an analog to digital converter for converting said analog amplified signal to a digital measured current, said microcontroller comprising a PWM generator for generating a PWM signal based on the difference between said measured current and said reference current, said PWM signal for controlling current output of said DC-DC converter.

2. The LED driver circuit of claim 1, wherein said power source is plurality of series connected ultracapacitors.

3. The LED driver circuit of claim 1, wherein said plurality of light emitting diodes comprise a plurality of series connected light emitting diodes.

4. A LED driver circuit for powering a plurality of light emitting diodes with a power source, said circuit comprising:

a DC-DC converter powered by said power source, said DC-DC converter for providing current to said light emitting diodes, said DC-DC converter controlled by a microcontroller through pulse width modulation (PWM);

a current feedback circuit for measuring the output of said DC-DC converter, said current feedback circuit comprising a measurement resistor connected in series with said light emitting diodes, wherein voltage measured across said measurement resistor is filtered by a filter and amplified by an operational amplifier to create an amplified signal, wherein said amplified signal is analog, and wherein said microcontroller further comprises an analog to digital converter for converting said analog amplified signal to a digital measured current; and said microcontroller, said microcontroller for generating a reference current, said microcontroller comprising a PWM generator for generating a PWM signal based on the difference between said digital measured current and said reference current, said PWM signal for controlling current output of said DC-DC converter.

5. The LED driver circuit of claim 4, wherein said power source is plurality of series connected ultracapacitors.

6. The LED driver circuit of claim 4, wherein said light emitting diodes are series connected.

7. The LED driver circuit of claim 4, wherein said power source is at least one ultracapacitor or at least one battery.

8. The LED driver circuit of claim 7, wherein said power source is a plurality of ultracapacitors connected in series, parallel or a combination of series and parallel.

9. A method of driving at least one light emitting diode with a power source, said method comprising the steps of:

generating an internal reference current using a microcontroller, said microcontroller comprising an analog to digital converter;

measuring the current from a DC-DC converter powered by said power source, said DC-DC converter driving said at least one light emitting diode;

filtering and amplifying said measured current to create an analog amplified signal;

converting said analog amplified signal to a digital measured current using said microcontroller;

supplying said digital measured current and said internal reference current to a closed loop control;

using said closed loop control to generate a PWM signal;

controlling the output current of said DC-DC converter using said PWM signal; and driving said at least one light emitting diode with said output current.

10. The method of claim 9, wherein the said measured current is determined by measuring the voltage across a measurement resistor.

11. The method of claim 9, wherein said amplification is accomplished using an operational amplifier.

12. The method of claim 9, wherein the power source is at least one ultracapacitor.

13. The method of claim 9, wherein said power source is a plurality ultracapacitors connected in series, parallel or combinations of series and parallel.

14. The method of claim 9, wherein said internal reference current is changed based upon user input.

15. The method of claim 9, wherein the power source is at least one battery.

16. The method of claim 9, wherein said power source is a plurality of batteries connected in series, parallel or combinations of series and parallel.

17. The method of claim 9, wherein said internal reference current is changed based upon temperature.

18. The method of claim 9, wherein said internal reference current is changed based upon time.

19. The method of claim 9, wherein said closed loop control is a proportional-integral-derivative control.

20. The method of claim 9, wherein said closed loop control is a proportional-integral control.

21. The method of claim 9, wherein said closed loop control is a proportional derivative control.

22. The method of claim 9, wherein said closed loop control is an integral control.

* * * * *